US009696738B2

(12) United States Patent
Merkin et al.

(10) Patent No.: US 9,696,738 B2
(45) Date of Patent: Jul. 4, 2017

(54) LOW POWER IDEAL DIODE CONTROL CIRCUIT

(71) Applicant: Texas Instruments Incorporated, Dallas, TX (US)

(72) Inventors: Timothy Bryan Merkin, Richardson, TX (US); Hassan Pooya Forghani-Zadeh, Fort Worth, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 14/978,532

(22) Filed: Dec. 22, 2015

(65) Prior Publication Data

US 2016/0187904 A1 Jun. 30, 2016

Related U.S. Application Data

(60) Provisional application No. 62/096,673, filed on Dec. 24, 2014, provisional application No. 62/195,113, filed on Jul. 21, 2015.

(51) Int. Cl.
*G05F 1/575* (2006.01)

(52) U.S. Cl.
CPC ..... *G05F 1/575* (2013.01)

(58) Field of Classification Search
CPC ..... G05F 1/575
USPC ..... 323/273–281; 327/535
See application file for complete search history.

(56) References Cited

U.S. PATENT DOCUMENTS 4,291,266 A * 9/1981 Portmann ..... G04C 10/02 136/293
5,945,816 A * 8/1999 Marusik ..... G05F 1/56 307/86
2010/0103709 A1* 4/2010 Tofigh ..... H02M 7/217 363/127
2011/0304360 A1 12/2011 Nakamura et al.

FOREIGN PATENT DOCUMENTS

JP 2013042193 A 2/2013
RU 2451385 C1 5/2012

OTHER PUBLICATIONS

International Search Report and Written Opinion for PCT/US2015/067747 mailed May 5, 2016; 6 pages.

* cited by examiner

*Primary Examiner* — Adolf Berhane
*Assistant Examiner* — Bart Iliya
(74) *Attorney, Agent, or Firm* — Michael A. Davis, Jr.; Charles A. Brill; Frank D. Cimino

(57) ABSTRACT

A circuit that operates as a low-power ideal diode is disclosed, as well as an IC chip that contains the ideal diode circuit. The circuit includes a first P-channel transistor connected to receive an input voltage on a first terminal and to provide an output voltage on a second terminal, a first amplifier connected to receive the input voltage and the output voltage and to provide a first signal that dynamically biases a gate of the first P-channel transistor as a function of the voltage across the first P-channel transistor, and a second amplifier connected to receive the input voltage and the output voltage and to provide a second signal that acts to turn off the gate of the first P-channel transistor responsive to the input voltage being less than the output voltage.

17 Claims, 4 Drawing Sheets

LOW POWER IDEAL DIODE CONTROL CIRCUIT

CLAIM OF PRIORITY AND RELATED PATENT APPLICATIONS

This nonprovisional application claims priority based upon the following prior U.S. provisional patent application (s): (i) "A VERY LOW POWER IDEAL DIODE CONTROL CIRCUIT WITH BOTH FAST REVERSE RECOVERY AND FAST FORWARD RECOVERY," Application No. 62/096,673, filed Dec. 24, 2014, in the name(s) of Timothy Bryan Merkin and Hassan Pooya Forghani-Zadeh, and (ii) "A VERY LOW POWER IDEAL DIODE CONTROL CIRCUIT WITH BOTH FAST REVERSE RECOVERY AND FAST FORWARD RECOVERY," Application No. 62/195,113, filed Jul. 21, 2015, in the name(s) of Timothy Bryan Merkin and Hassan Pooya Forghani-Zadeh, which are both hereby incorporated by reference in their entirety.

FIELD OF THE DISCLOSURE

Disclosed embodiments relate generally to the field of circuit design. More particularly, and not by way of any limitation, the present disclosure is directed to a circuit, chip and method that controls a transistor to provide the functionality of an ideal diode having both fast forward recovery and fast reverse recovery.

BACKGROUND

In low power applications that require a diode, the forward voltage drop of the diode can create either supply headroom issues or excessive power dissipation. A Schottky diode can reduce this voltage drop, but Schottky diodes aren't available in most semiconductor processes. To avoid these issues, a single transistor can be used in place of the diode, with the gate voltage of the transistor controlled to act as an ideal diode. There is a need for an "ideal diode" circuit that has a fast forward drop recovery and a fast reverse recovery with low voltage headroom for very low power applications.

SUMMARY

The present patent application discloses an ideal diode circuit and a chip containing an ideal diode. The ideal diode circuit may include low power, low voltage operation, fast reverse recovery speed, and fast forward recovery speed.

In one aspect, an embodiment of a circuit that operates as a low-power ideal diode is disclosed. The circuit includes a first P-channel transistor connected to receive an input voltage on a first terminal and to provide an output voltage on a second terminal; a first amplifier connected to receive the input voltage at a first input and the output voltage at a second input and to provide a first signal that dynamically biases a gate of the first P-channel transistor as a function of the voltage across the first P-channel transistor; and a second amplifier connected to receive the input voltage at a first input and the output voltage at a second input and to provide a second signal that acts to turn off the gate of the first P-channel transistor responsive to the input voltage being less than the output voltage.

In another aspect, an embodiment of a power management chip is disclosed. The power management chip includes a first connection for a first power supply having a first voltage; a second connection for a second power supply having a second voltage higher than the first voltage; and an internal power rail for the chip, wherein the first power supply and the second power supply are each connected to the internal power rail through a circuit comprising: a first P-channel transistor connected to receive an input voltage on a first terminal and to provide an output voltage on a second terminal; a first amplifier connected to receive the input voltage at a first input and the output voltage at a second input and to provide a first signal that dynamically biases a gate of the first P-channel transistor as a function of the voltage across the first P-channel transistor; and a second amplifier connected to receive the input voltage at a first input and the output voltage at a second input and to provide a second signal that acts to turn off the gate of the first P-channel transistor responsive to the input voltage being less than the output voltage.

Advantages of the disclosed circuit may include one or more of the following: low power, low voltage operation, quick recovery in the forward direction, quick recovery the reverse direction, and small area. At least one embodiment of the disclosed circuit is in an all Complementary Metal-Oxide Semiconductor (CMOS) design.

BRIEF DESCRIPTION OF THE DRAWINGS

Embodiments of the present disclosure are illustrated by way of example, and not by way of limitation, in the Figures of the accompanying drawings in which like references indicate similar elements. It should be noted that different references to "an" or "one" embodiment in this disclosure are not necessarily to the same embodiment, and such references may mean at least one. Further, when a particular feature, structure, or characteristic is described in connection with an embodiment, it is submitted that it is within the knowledge of one skilled in the art to effect such feature, structure, or characteristic in connection with other embodiments whether or not explicitly described.

The accompanying drawings are incorporated into and form a part of the specification to illustrate one or more exemplary embodiments of the present disclosure. Various advantages and features of the disclosure will be understood from the following Detailed Description taken in connection with the appended claims and with reference to the attached drawing Figures in which:

DETAILED DESCRIPTION OF THE DRAWINGS

Specific embodiments of the invention will now be described in detail with reference to the accompanying figures. In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

A diode's primary purpose is to allow current in a single direction. Ideally, this means zero forward biased voltage drop, zero reverse current, and zero equivalent series resistance when forward biased. The closest approximation of these ideals can be achieved by using a single transistor as a switch and controlling the gate voltage as a function of the voltage across it. Several timing issues are also important in the optimal operation of an ideal diode. For example, if a diode is conducting in a forward condition and is immediately switched to a reverse condition, the diode will conduct in a reverse direction for a short time as the forward voltage bleeds off. The current through the diode will be fairly large in a reverse direction during this small recovery time, known as reverse recovery time. After the carriers have been flushed and the diode is acting as a normal blocking device in the reversed condition, the current flow should drop to leakage levels. Similarly, forward recovery time is the time required for the voltage to reach a specified value after a large change in forward biasing. It is desirable that both the reverse recovery time and the forward recovery time be minimized.

Figure 1:
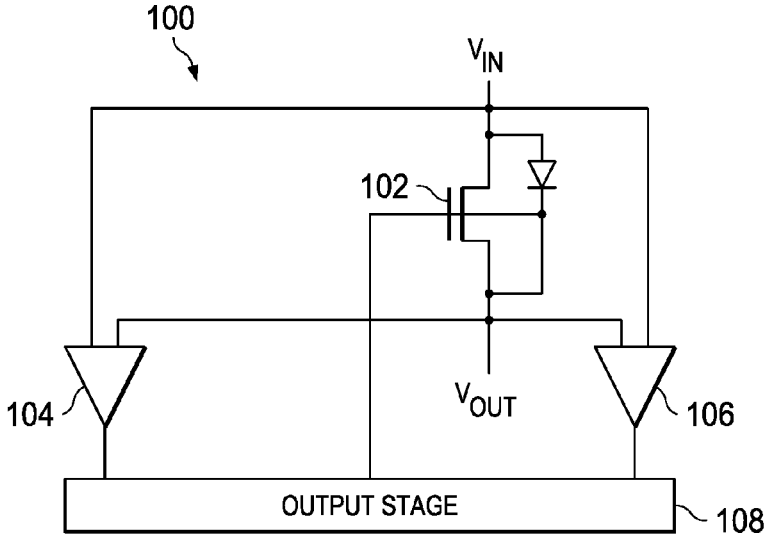
FIG. 1 illustrates an example of a circuit that operates as a low-power ideal diode according to an embodiment of the disclosure.

Referring now to the drawings and more particularly to FIG. 1, a circuit 100 that operates as a low-power ideal diode according to an embodiment of the disclosure is shown. Transistor 102 receives an input voltage $V_{IN}$ on a first terminal and provides an output voltage $V_{OUT}$ on a second terminal. The body of Transistor 102, as created, contains two parasitic diodes facing in opposite directions. However, in the embodiment shown, the gate of Transistor 102 has been connected to the body to short out one of the parasitic diodes, so only one diode is shown. Transistor 102 is the main pass transistor and its gate is controlled to perform as a diode. Amplifier 104 is connected to receive $V_{IN}$ and $V_{OUT}$ as inputs and to provide an output to Output Stage 108. Similarly, Amplifier 106 is also connected to receive $V_{IN}$ and $V_{OUT}$ as inputs and to provide an output to Output Stage 108. The output of Output Stage 108 is then connected to control the gate of Transistor 102. In at least one embodiment, Output Stage 108 is simply a node that combines the outputs of Amplifier 102 and Amplifier 104. In at least one embodiment, Output Stage 108 is a circuit that receives the outputs of Amplifier 102 and Amplifier 106 in a manner that smooths the operation of Transistor 102. To achieve the goal of an ideal amplifier, Amplifier 104 is configured to provide a shortened turn-off time for Transistor 102 whenever $V_{OUT}$ becomes greater than $V_{IN}$ and Amplifier 106 is configured to dynamically bias the gate of Transistor 102 as a function of the voltage across Transistor 102. That is, if VOUT drops, e.g., due to a change in load, Amplifier 106 will adjust the gate of Transistor 106 to follow the changing needs.

Figure 2:
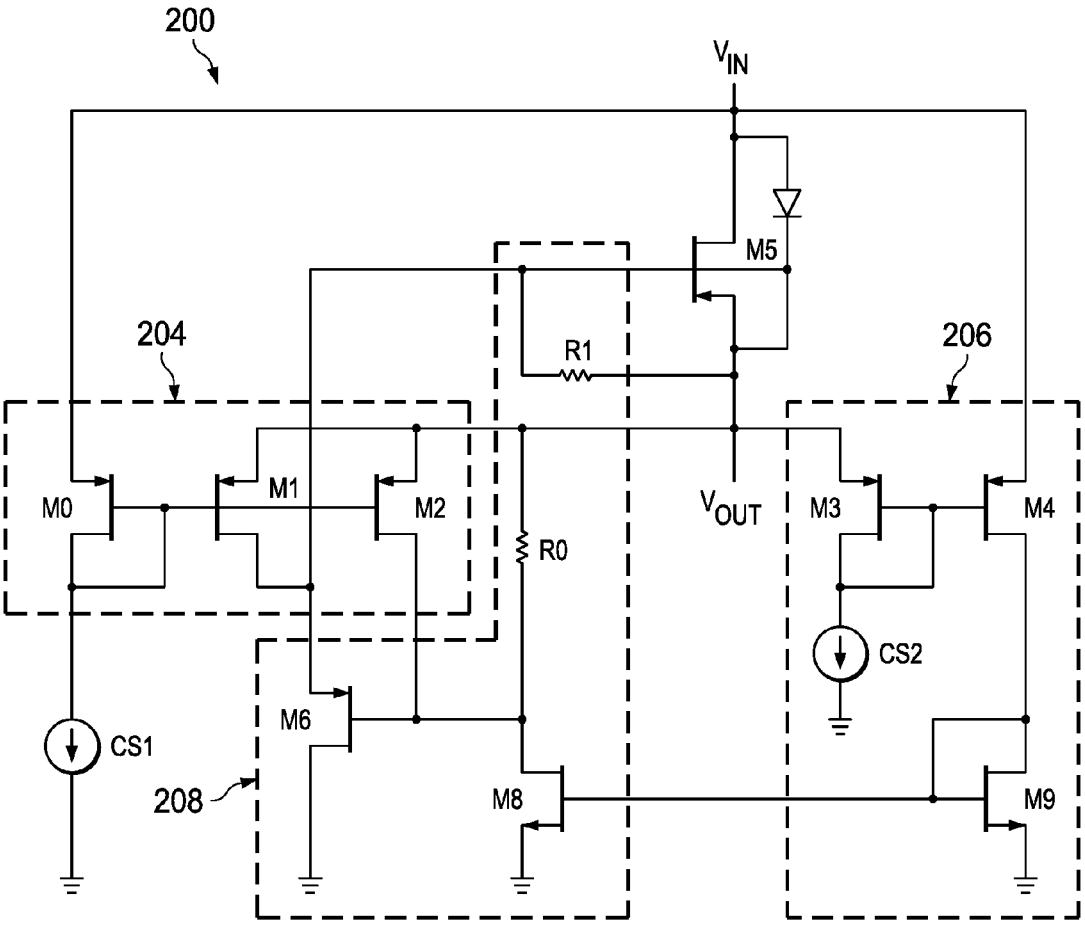
FIG. 2 illustrates a specific implementation of the circuit of FIG. 1 according to an embodiment of the disclosure.

Turning next to FIG. 2, circuit 200 is a specific implementation of circuit 100. In at least one embodiment, which is discussed herein, circuit 200 is implemented in CMOS technology. However; the disclosed circuit can also be realized in other technologies, e.g., bipolar junction transistors. It will be understood by one skilled in the art that reference to CMOS technology or to component elements such as N-Channel MOS (NMOS) and P-Channel MOS (PMOS) technology is often a misnomer in that the "metal" in CMOS circuits can be replaced with doped polysilicon and the "oxide" can be replaced with other passivation layers. However, this terminology persists in spite of these changes. Accordingly, any reference to CMOS, NMOS and PMOS in the present disclosure should be understood to refer more generally to any related type of transistor technology, such as Insulated-Gate Field-Effect (IGFET) or Metal-Insulator-Semiconductor FET (MISFET). In circuit 200, Transistor M5 is a PMOS transistor that is controlled to perform as a diode. Like Transistor 102, M5 receives $V_{IN}$ at a first terminal and provides $V_{OUT}$ at a second terminal. The source of M5 is shown in this figure as being connected to $V_{OUT}$, and the drain to $V_{IN}$. The transistor is shown this way to emphasize the fact that $V_{OUT}$ for this circuit can sometimes be greater than $V_{IN}$, which is the reason that M5 is to act as a diode to prevent the backflow of current. One skilled in the art will understand that the source and drain of M5 can be viewed as interchangeable, depending on whether $V_{IN}$ or $V_{OUT}$ is higher. The gate of M5 is connected to the source of M5 (as shown) through resistor R1 and is also connected to the source of PMOS Transistor M6, as will be further explained below. As in FIG. 1, the gate of M5 is connected to the body of M5 to short out one parasitic diode, so that only the parasitic diode shown is active. In at least one embodiment, the threshold voltage of the parasitic diode of M5 is about 0.7 volts. This threshold is too high to be useful in low-power situations, such as on portable devices, which typically operate on 3-5 volts. Thus, M5 is controlled to have a much lower threshold voltage, as will be explained below.

M0 is a diode-connected PMOS transistor having a source connected to $V_{IN}$ and a drain connected through current source CS1 to the lower rail, herein referred to as ground. The gate of M0 is tied to the gates of PMOS Transistors M1 and M2 to form a common-gate amplifier. M1 has a source connected to $V_{OUT}$ and a drain connected between the source of M6 and the gate of M5. M2 also has a source connected to $V_{OUT}$; the drain of M2 is connected to the gate of M6. Transistor M6 has a source connected to M5, a drain connected to ground and a gate that receives input from M2, M8 and R0, where R0 is connected between $V_{OUT}$ and the drain of NMOS Transistor M8, while the source of M8 is connected to ground. Diode-connected PMOS Transistor M3 has a source connected to $V_{OUT}$ and a drain connected through current source CS2 to ground. PMOS Transistor M4 has a source connected to $V_{IN}$ and a drain connected to the drain of diode-connected NMOS Transistor M9. The source of M9 is connected to ground. The gates of M3 and M4 are connected together to form an Operational Transconductance Amplifier (OTA) and the gates of M8 and M9 are connected to mirror the current output from M4 and provide a voltage to M6.

In the disclosed embodiment, M0, M1 and M2 together form Amplifier 204, which, like Amplifier 104 of FIG. 1, works to speed up the turn-off of transistor M5 when $V_{OUT}$ becomes greater than $V_{IN}$. Likewise, M3, M4 and M9 form Amplifier 206, which like Amplifier 106, acts to dynamically bias the gate of M5 as a function of the voltage across M5. Transistors M6 and M8 together with Resistors R0 and R1 form Output Stage 208, which combines the outputs of Amplifiers 204, 206 to provide a smooth operation for M5. Another way to look at this embodiment is to define M3, M4, M9, M8, R0 and M6 as part of a forward regulating loop while M0, M1 and M2 form a reverse blocking speed-up loop that aids in the shut-off speed of M5.

The operation of Circuit 200 is as follows. Looking first at Output Stage 208, the gate of M5 is controlled by M6, which can pull the gate of M5 towards ground when M6 is on, and also by M1, which can pull the gate of M5 upwards towards $V_{OUT}$ when M1 is on. The degree to which M6 is turned on is determined by three elements: R0 will always pull the gate of M6 towards $V_{OUT}$; M8, when turned on, will pull the gate of M6 towards ground; and M2, when turned on, will assist in pulling the gate of M6 towards $V_{OUT}$.

When $V_{IN}$ is greater than $V_{OUT}$ and current is flowing in a forward direction through M5, Amplifier 206 operates as follows to ensure quick forward recovery. M3 acts as a floating reference voltage for Amplifier 206 such that M4 essentially sees the voltage across M5. If $V_{OUT}$ goes low suddenly, the gate of M3 is pulled downward and will pull down on the gate of M4. M4 will then have a large gate/source voltage $V_{GS}$, and will quickly allow increased current to M9, which also increases the voltage on the gate of M9. The gate of M9 will mirror the increased voltage on the gate of M8 so that M8 will turn on more fully. Turning on M8 will pull downward on the gate of M5, turning M6 on more strongly, which ultimately turns on M5 more strongly, providing the additional power needed. When $V_{OUT}$ becomes greater than $V_{IN}$, the reverse will happen, with M4 being shut off, which in turn shuts off M9 and M8. With M8 turned off, R0 will eventually pull the gate of M6 to $V_{OUT}$ and turn off both M6 and M5, although by itself R0 acts more slowly than desired. This is the time when the action of Amplifier 204 becomes useful.

In Amplifier 204, M0 acts as a floating reference voltage so that M1 and M2 both see the voltage across M5. If $V_{OUT}$ is greater than $V_{IN}$, the source of both M1 and M2 goes high, while their respective gates remain low because of the connection to the gate of M0. The low gate voltages and high source voltages turn both M1 and M2 on strongly, allowing more current to flow. M1 pulls the source of M6 towards $V_{OUT}$ and M2 helps to pull the gate of M6 towards $V_{OUT}$, which acts to turn off M6 and M5. Because of the action of Amplifier 204, M5 is able to turn off much more quickly than would happen with only R0 pulling up on the gate.

It can be seen that in this embodiment that the forward regulating loop is controlled by the differential pair M3/M4 and the load is R0. This loop can be made output pole dominant with low impedance at the source of M6 and with R0 reducing effective impedance at the drain of M8, and a large decoupling capacitor on $V_{OUT}$. One characteristic of the forward loop in this circuit is the fast forward recovery to heavy load steps. The reverse recovery speed-up loop in this circuit is not activated under normal forward bias conditions, but only when the voltage on $V_{OUT}$ increases above $V_{IN}$. Note that there is no current flow from $V_{OUT}$ to ground when $V_{OUT}$ is greater than $V_{IN}$.

Figure 3:
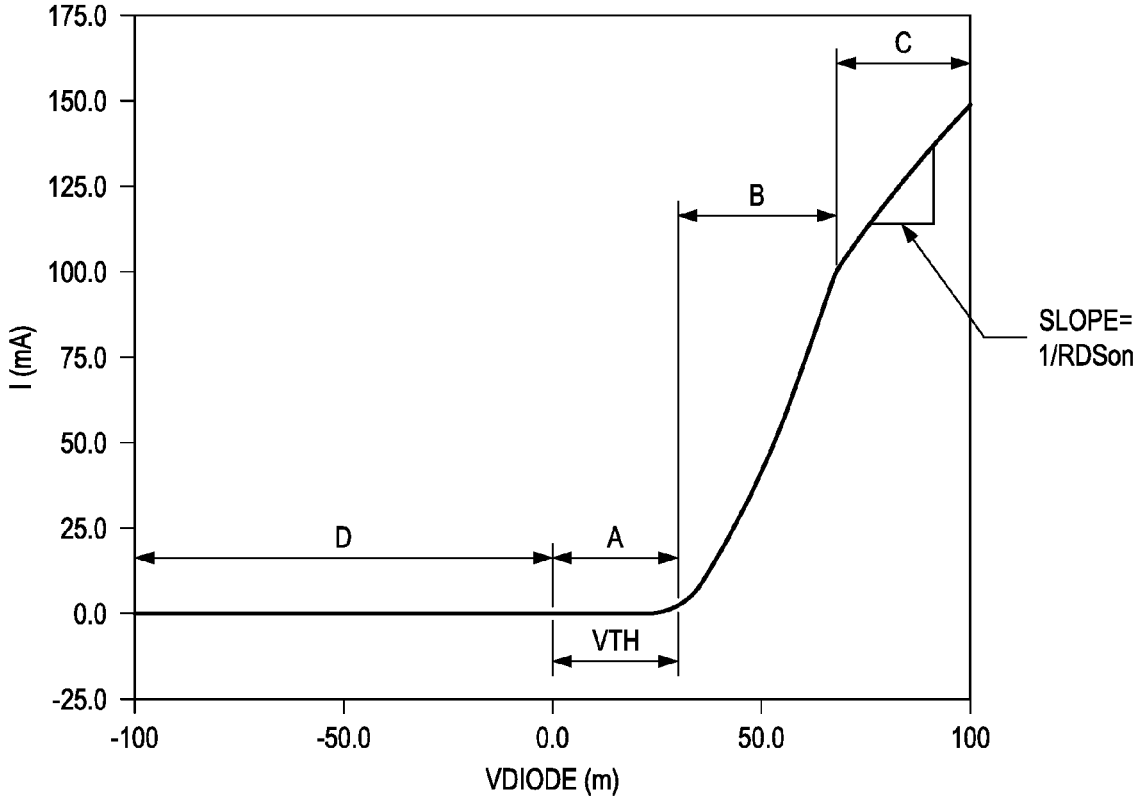
FIG. 3 depicts the diode characteristics of the circuit of FIG. 2 in terms of voltage and current.

FIG. 3 illustrates the DC current-voltage (I-V) curve characteristics of the embodiment of FIG. 2. In the embodiment illustrated, the current through M5 is zero for all negative voltages in region D of the curve, i.e., when $V_{OUT}$ is greater than $V_{IN}$. As $V_{IN}$ becomes greater than $V_{OUT}$, the current remains zero in region A until the threshold voltage, $V_{TH}$ is reached at about 30 millivolts. For comparison, the threshold voltage of a regular diode in this technology would be about 700 millivolts. Thus the disclosed circuit can be used in situations where voltage headroom is a concern or where power loss due to current flowing through a real diode is a concern. $V_{TH}$ is determined by the transconductance of differential pair M3, M4 times the resistance of R0. Above $V_{TH}$, the current rises at a first rate in region B until the transistor is fully turned on. Once the transistor is fully turned on, e.g., in region C, the slope of the I-V curve is a second value that is equal to the inverse of the drain/source resistance, i.e., $1/RDS_{on}$. The current to run the disclosed circuit is taken from either the input current or the output current and can be very low power. In at least one implementation of the disclosed control circuitry, the quiescent current supply ($I_{DDQ}$) for the circuit is about 1.25 μA. Thus, in at least some implementations, the quiescent current supply is in the micro-amp range. The circuitry can be pushed even lower if needed, depending on design requirements, e.g., into the nano-amp range.

Figure 4:
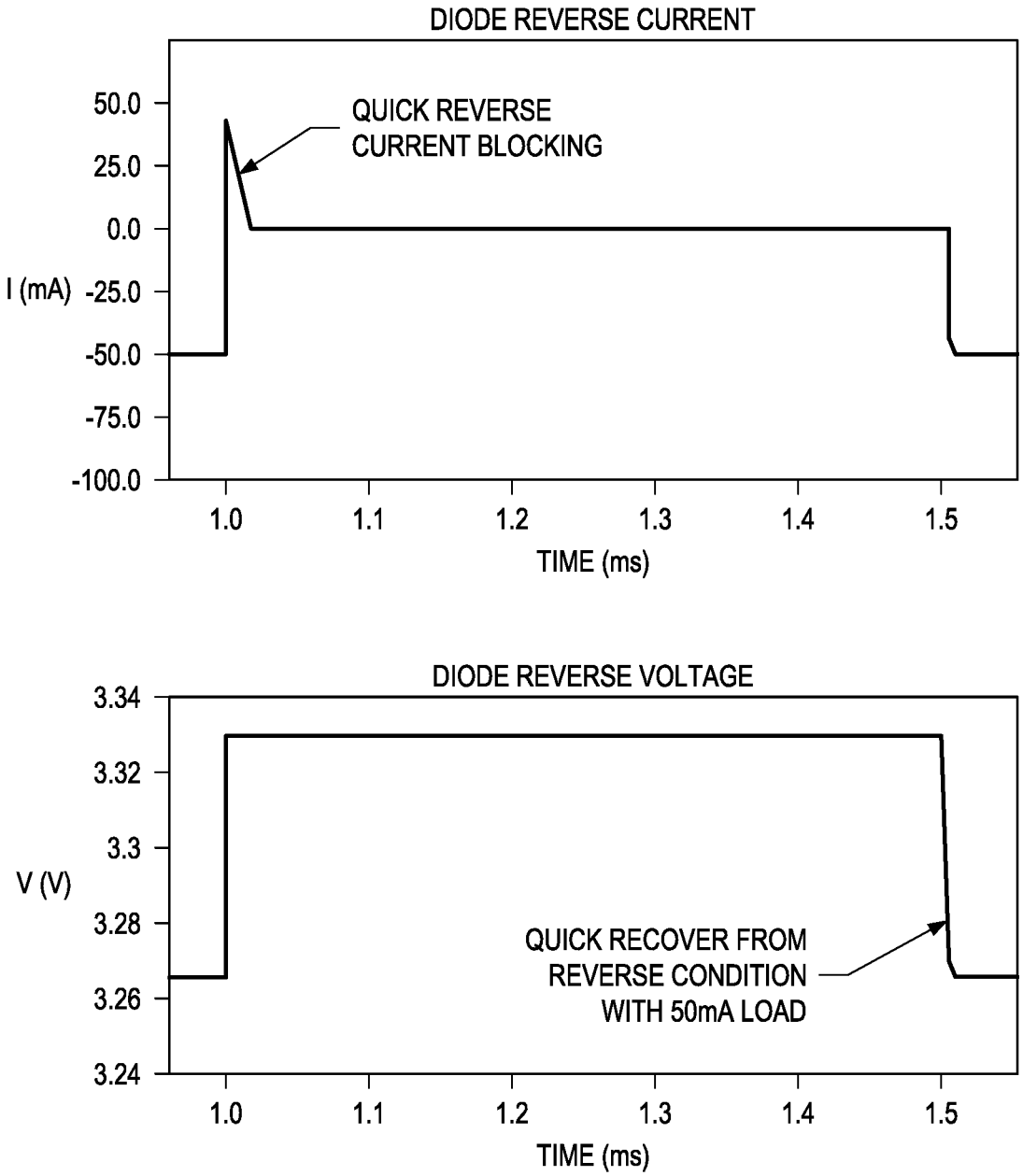
FIG. 4 depicts the transient diode characteristics of the circuit of FIG. 2.

FIG. 4 illustrates the transient characteristics of the ideal diode that is enabled by the disclosed embodiments. As shown in the lower graph, the output voltage $V_{OUT}$ of the embodiment of FIG. 2 was switched from about 3.265 V to 3.33 V while the input voltage $V_{IN}$ was held at 3.3 V (not specifically shown). After 0.5 milliseconds, the output voltage was dropped back to its former level. The current response through ideal diode M5 is shown in the upper graph. As the reverse voltage was applied, a reverse current appeared, peaking at around 42 mA, but within 0.020 ms, the reverse current fell to zero. When the reverse voltage condition was removed, the current returned to previous levels. Note that no undershooting occurred in the voltage during recovery, even though this is a common problem in ideal diode circuits.

Figure 5:
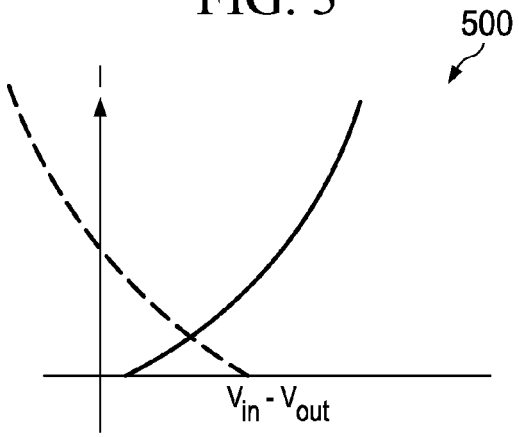
FIG. 5 depicts overlapping regions of operation of the circuit of FIG. 1.

FIG. 5 illustrates the region of operation 500 of both Amplifier 204 and Amplifier 206 according to one embodiment of the disclosure and plots the I-V graph for each of these amplifiers, where the voltage is measured as $V_{IN}-V_{OUT}$. This figure is not drawn to scale and is offered simply to illustrate that the operation of these two amplifier circuits will overlap. The dotted line represents the curve for Amplifier 204 and the solid line represents the curve for Amplifier 206. As can be seen in this figure, when the difference in voltages is in the negative region, i.e., $V_{OUT}$ is greater than $V_{IN}$, only Amplifier 204 operates. As the voltage difference becomes more positive, the current from Amplifier 204 drops and the current from Amplifier 206 starts to grow, such that both amplifiers are acting at the same time. Finally, a point is reached where Amplifier 204 is completely turned off and only Amplifier 206 is active. This handoff between Amplifier 204 and Amplifier 206 provides a smooth operation of the circuit as a whole. The actual curve for each amplifier circuit is determined by the threshold voltages of the transistors in each circuit and the transconductance of the devices.

There are many applications for the control circuitry disclosed above, including:

- Zero reverse current switch;
- Ideal diode OR-ing of multiple power sources with very little power loss (important in many low power battery operated devices); and
- Inside an Low Dropout (LDO) feedback loop to block any reverse current into the supply of the LDO.

Figure 6:
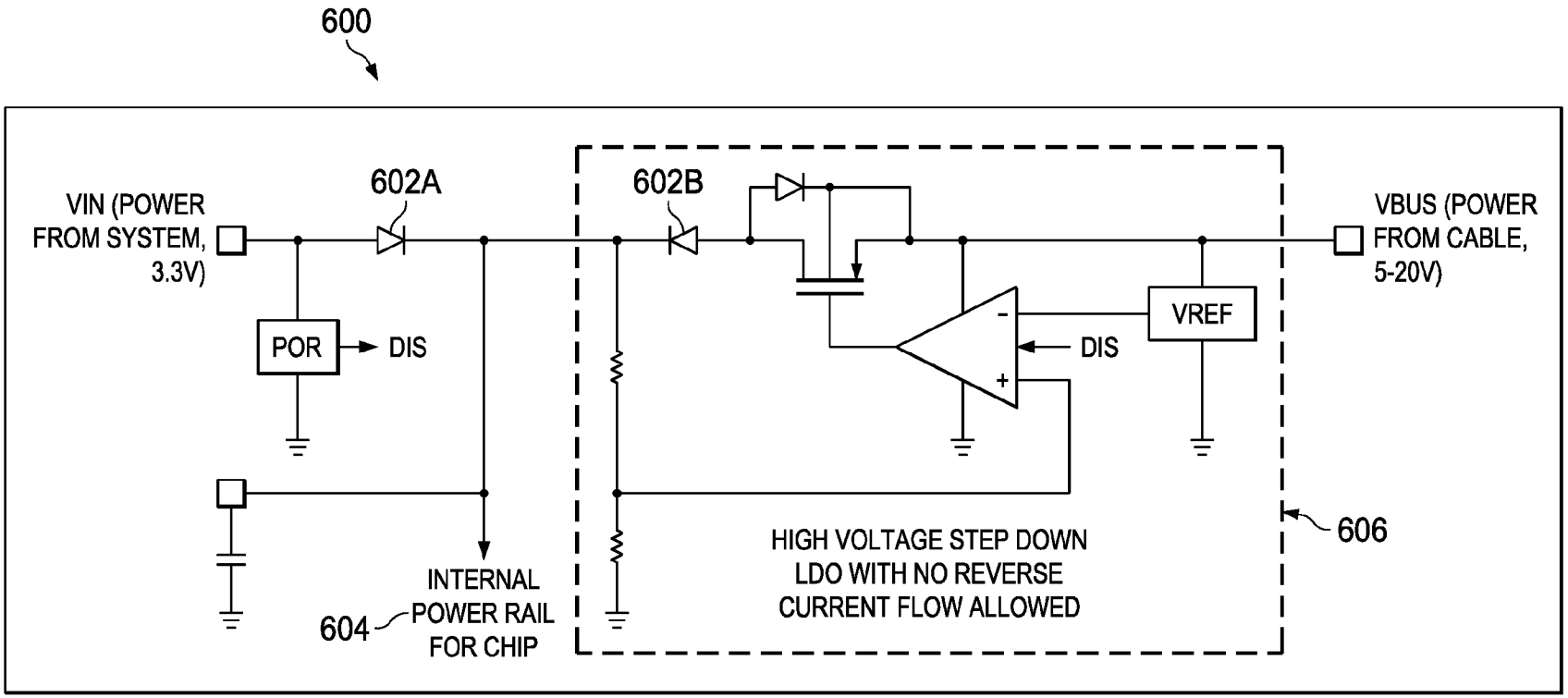
FIG. 6 depicts a chip that incorporates the circuit of FIG. 1 according to an embodiment of the disclosure.

FIG. 6 illustrates the use of the disclosed ideal diode circuit in a larger circuit that has been realized in an Integrated Circuit (IC) Chip 600. The circuit shown in IC Chip 600 uses PMOS based ideal diodes 602A, 602B to create a single, diode-OR'ed internal power rail 604 from either VBUS, which connects to a cable (in the case of dead battery), or VIN, the system power supply at 3.3 V, with priority given to VIN. Notably, all low voltage elements can be used in ideal diode 602B as this diode appears on the low voltage side of LDO Regulator 606. It will be recognized that FIG. 6 discloses two diode-OR'ed inputs; however, this is not a limitation, as this approach can be scaled to an unlimited number of input supplies.

Although various embodiments have been shown and described in detail, the claims are not limited to any particular embodiment or example. None of the above Detailed Description should be read as implying that any particular component, element, step, act, or function is essential such that it must be included in the scope of the claims. Reference to an element in the singular is not intended to mean "one and only one" unless explicitly so stated, but rather "one or more." All structural and functional equivalents to the elements of the above-described embodiments that are known to those of ordinary skill in the art are expressly incorporated herein by reference and are intended to be encompassed by the present claims. Accordingly, those skilled in the art will recognize that the exemplary embodiments described herein can be practiced with various modifications and alterations within the spirit and scope of the claims appended below.

What is claimed is:

1. A circuit comprising:

a first P-channel transistor connected to receive an input voltage on a first terminal and to provide an output voltage on a second terminal;

a first amplifier connected to receive the input voltage at a first input and the output voltage at a second input and to provide a first signal that dynamically biases a gate of the first P-channel transistor as a function of the voltage across the first P-channel transistor; and a second amplifier connected to receive the input voltage at a first input and the output voltage at a second input and to provide a second signal that acts to turn off the gate of the first P-channel transistor responsive to the input voltage being less than the output voltage.

2. The circuit as recited in claim 1 wherein a region of operation of the first amplifier overlaps a region of operation of the second amplifier.

3. The circuit as recited in claim 2 further comprising a shared output stage connected to receive the first signal and the second signal and to control the gate of the first P-channel transistor.

4. The circuit as recited in claim 3 wherein the shared output stage comprises a second P-channel transistor connected to pull the gate of the first P-channel transistor towards a lower rail when the second P-channel transistor is turned on, the gate of the second P-channel transistor receiving input from the first amplifier and the second amplifier.

5. The circuit as recited in claim 4 wherein the first amplifier comprises a third P-channel transistor having a source connected to the output voltage and a fourth P-channel transistor having a source connected to the input voltage, the third and fourth P-channel transistors forming an operational transconductance amplifier (OTA) that provides an output to a first N-channel transistor that mirrors a gate voltage of the first N-channel transistor to the output stage.

6. The circuit as recited in claim 5 wherein the third P-channel transistor is a floating DC voltage reference.

7. The circuit as recited in claim 5 wherein the second amplifier comprises a fifth, a sixth and a seventh P-channel transistor forming a common-gate amplifier, the fifth P-channel transistor having a source connected to the input voltage and the sixth and seventh P-channel transistors each having a source connected to the output voltage.

8. The circuit as recited in claim 7 wherein the fifth P-channel transistors is a floating DC voltage reference.

9. The circuit as recited in claim 8 wherein the sixth P-channel transistor has a drain connected to pull the gate of the first P-channel transistor towards the output voltage when on and the seventh P-channel transistor has a drain connected to pull the gate of the second P-channel transistor towards the output voltage when on.

10. The circuit as recited in claim 9 wherein the shared output stage further comprises a first resistor coupled between the output voltage and a drain of a first N-channel transistor, the source of the first N-channel transistor being tied to the lower rail, wherein the gate of the second P-channel transistor is connected to a point between the first resistor and the first N-channel transistor.

11. The circuit as recited in claim 10 wherein the shared output stage further comprises a second resistor connected between the gate and the second terminal of the first P-channel transistor.

12. The circuit as recited in claim 2 wherein the circuit is embodied in Complementary Metal-Oxide Semiconductor (CMOS) technology.

13. The circuit as recited in claim 2 wherein a quiescent current in the circuit is less than about 1.25 μA.

14. The circuit as recited in claim 2 wherein no current flows from the second terminal to a lower rail when the output voltage is greater than the input voltage.

15. The circuit as recited in claim 1 wherein the circuit is configured to operate as a low-power ideal diode.

16. A power management chip comprising:

a first connection for a first power supply having a first voltage;

a second connection for a second power supply having a second voltage different than the first voltage; and an internal power rail for the chip, wherein the first power supply and the second power supply are each connected to the internal power rail through a circuit comprising:

a first P-channel transistor connected to receive an input voltage on a first terminal and to provide an output voltage on a second terminal;

a first amplifier connected to receive the input voltage at a first input and the output voltage at a second input and to provide a first signal that dynamically biases a gate of the first P-channel transistor as a function of the voltage across the first P-channel transistor; and a second amplifier connected to receive the input voltage at a first input and the output voltage at a second input and to provide a second signal that acts to turn off the gate of the first P-channel transistor responsive to the input voltage being less than the output voltage.

17. The power management chip as recited in claim 16 wherein the power management chip is a USB Type-C and USB-PD port power management chip.

* * * * *